US005862752A

United States Patent [19]

Takahashi et al.

[11] Patent Number: 5,862,752

[45] Date of Patent: Jan. 26, 1999

[54] USED STENCIL RECEPTACLE

[75] Inventors: Takayuki Takahashi, Shibata-machi; Kazuhisa Takahashi, Murata-machi; Hideyuki Kagawa; Yoshiharu Kanno, both of Sendai; Terunobu Ohnuma, Kawasaki-machi, all of Japan

[73] Assignee: Tohoku Ricoh Co., Ltd., Miyagi, Japan

[21] Appl. No.: 691,922

[22] Filed: Aug. 1, 1996

[30] Foreign Application Priority Data

| | | | |
|---|---|---|---|
| Sep. 14, 1995 | [JP] | Japan | 7-236880 |
| Jun. 11, 1996 | [JP] | Japan | 8-149462 |
| Jun. 19, 1996 | [JP] | Japan | 8-158415 |

[51] Int. Cl.[6] ..... B41L 47/14; B41F 15/14

[52] U.S. Cl. ..... 101/114

[58] Field of Search ..... 101/114

[56] References Cited

U.S. PATENT DOCUMENTS

| | | | |
|---|---|---|---|
| 5,090,310 | 2/1992 | Motoe | 101/114 |
| 5,133,919 | 7/1992 | Hasegawa et al. | 101/114 |
| 5,323,699 | 6/1994 | Motoe et al. | 101/114 |
| 5,323,706 | 6/1994 | Sugawara | 101/114 |
| 5,564,335 | 10/1996 | Motoe et al. | 101/114 |
| 5,623,871 | 4/1997 | Takahira | 101/114 |
| 5,632,200 | 5/1997 | Fukai | 101/114 |

FOREIGN PATENT DOCUMENTS

| | | |
|---|---|---|
| 59-11281 | 1/1984 | Japan . |
| 61-185471 | 8/1986 | Japan . |
| 5-36709 | 9/1993 | Japan . |
| 6-40138 | 2/1994 | Japan . |
| 6-25342 | 7/1994 | Japan . |
| 7-55090 | 12/1995 | Japan . |

*Primary Examiner*—Edgar S. Burr
*Assistant Examiner*—Amanda B. Sandusky
*Attorney, Agent, or Firm*—Oblon, Spivak, McClelland, Maier & Neustadt, P.C.

[57] ABSTRACT

A used stencil receptacle for facilitating the disposal of used stencils. The used stencil receptacle is in the shape of a box, and comprises a base, a pair of long straight sides, a short straight side, and an open side or a movable side which is freely opened and closed.

13 Claims, 15 Drawing Sheets

USED STENCIL RECEPTACLE

BACKGROUND OF THE INVENTION

1. Field of the Invention

This invention relates to a receptacle for storing used stencils.

2. Description of the Prior Art

Box-shaped receptacles have been used for storing used stencils. Such receptacles have a base, a pair of long straight sides and a pair of short straight sides, and are without a lid, and receive and store used stencils discharged from a printing machine.

FIG. 19 of the accompanying drawings shows the configuration of a lithographic printing machine 34 , which comprises a document reader 34*a*, a stencil perforating section 34*b*, a printing drum 1, a sheet tray 34*c*, a sheet feeder 34*d*, a stencil discharging section 34*e*, and so on. A used stencil receptacle 5 constitutes part of the sheet discharging section 34*e*. When the printing machine 34 starts operating in an automatic stencil perforating mode, the printing drum 1 is rotated in the direction opposite to that used in the printing operation as shown in FIG. 16, so that a used stencil will be received in the used stencil receptacle 5. In this state, a stencil take-up belt 3, which is kept away from the printing drum 1 with a stencil take-up belt 2 during the printing operation, is moved to a position shown by the solid line from the position shown by the dashed line. In other words, the stencil take-up belt 3 comes into contact with the printing drum 1. Then, a clamp (not shown) holding the leading edge of a stencil 4 frees the stencil 4.

A surface of the stencil take-up belt 3 in contact with the printing drum 1 rotates in a direction opposite to that of the printing drum 1, so that the trailing edge of the used stencil 4 is scooped up by the stencil take-up belt 3. The stencil 4 is then drawn into the space between the stencil take-up belts 2 and 3, is stripped off the printing drum 1, is continuously conveyed via the stencil take-up belts 2 and 3, and is put into the used stencil receptacle 5.

In addition to the foregoing method, several methods are available so as to strip the stencil from the printing drum 1. In one method, the used stencil 4 is stripped from the printing drum when the clamp frees the leading edge of the used stencil 4, without reversing the rotational direction of the printing machine 1. In another method, stencil take-up rollers which are disposed in the used stencil receptacle are utilized in place of the combination of the stencil take-up belts 2 and 3 and the used stencil receptacle. In any case, the used stencil is discharged into the used stencil receptacle 5.

The discharged stencils 4 fold naturally and are stacked in the used stencil receptacle 5, and are compressed by a pressing member 6 at appropriate times so as to store as much of the stencils 4 as possible.

The used stencil receptacle 5 full of the used stencils 4 is detached from the printing machine, so that the used stencils 4 can be discarded. The used stencil receptacle 5 is returned to the original position in the printing machine 34.

The used stencil receptacle 5 is box-shaped as shown in FIG. 17, and includes a rectangular base 5-1, a pair of short straight sides 5-2 and [5-3], and a pair of long straight sides 5-4 and 5-5. The used stencil receptacle 5 has an open top. The long straight side 5-5 has a grip 5-6.

It is assumed that each used stencil 4 has a size W in a direction parallel to the rotary axis of the printing drum 1, and a size L in a direction in which the used stencil 4 is conveyed. In this case, W is larger than L. Thus, the base 5-1 of the used stencil receptacle 5 is rectangular with size W×L. The used stencil receptacle 5 is long in the direction orthogonal to the direction in which the used stencil is paid.

The height of the used stencil receptacle 5 is determined on the basis of a height H of the maximum number of used stencils stacked therein. For instance, when a maximum number of A3 size stencils are stacked in the used stencil receptacle, W is 320 mm, L is 120 mm, and H is 120 mm.

The used stencil receptacle 5 full of used stencils is removed from the printing machine, and is emptied. The used stencil receptacle 5 will be returned into the printing machine 34.

Referring to FIGS. 17 to 19, when removing the used stencil receptacle 5, it is moved in a direction shown by the arrow 30 which is the same as the stencil feeding direction. Specifically, an operator standing before the front side of the printing machine moves the used stencil receptacle 5 to the left or right. The grip 5-6 on the side 5-5 is used when detaching the used stencil receptacle 5. As shown in FIG. 18, the used stencil receptacle 5 is secured at its pulling side by a holding member 31. Thus, first of all, the holding member 31 is opened as shown by the arrow 33 using a shaft 32 as a fulcrum, in the direction 30. Then, the used stencil receptacle 5 is pulled out of the printing machine 34 by pulling the grip 5-6.

In order to secure space for opening the holding member 31 and space for removing the used stencil receptacle 5 from the printing machine, a sorter 35 used in conjunction with the printing machine 34 has to be located at a position which is clear of the printing machine 34 by a distance K. The printing machine 34 and the sorter 35 constitute a printing system.

In the printing machine 34 of the prior art, the used stencil receptacle 5 is designed to be laterally moved (i.e. in the stencil feeding direction), viewed from an operator standing in front of the printing machine 34. Therefore, the operator extends his or her left arm and twists himself or herself so as to pull the used stencil receptacle 5 to the left. Further, since the used stencil receptacle 5 is pulled in the direction shown by the arrow 30, the sorter 35 should be kept away from the printing machine 34 by the distance K so as to retain enough space for pulling the holding member 31 and the used stencil receptacle 5.

Now, it is assumed that the used stencils are discharged from the receptacle 5 into a trash container. When the trash container has an opening whose size is larger than W×L, the used stencil receptacle 5 is simply reversed so that its contents will fall into the trash container by their own weight. However, large trash containers having such a large opening are not so popular. As shown in FIG. 20, a trash container 7 in wide use usually has an opening whose size is W'×W' and a height larger than W. The size W'×W' is slightly greater than the smaller sectional area with size L×L of the used stencils stacked in the used stencil receptacle 5.

When the used stencil receptacle 5 is appropriately reversed using an axis O-O as the center of rotation, used stencils 4 may not smoothly pass through the entrance of the trash container 7. Further, used stencils 4 sometimes remain stuck onto the used stencil receptacle 5, and are slow to fall into the trash container 7.

In order to overcome the foregoing problems, the operator has to grasp the used stencils 4, turn the used stencil receptacle 5 upside down so as to discharge the used stencils 4 into the trash container 7 with the longer side of the used stencils kept vertical. Sometimes, the used stencils 4 taken out of the used stencil receptacle 5 should be appropriately folded before they are discharged into the trash container 7.

SUMMARY OF THE INVENTION

The present invention is designed to provide a used stencil receptacle which facilitates disposal of a used stencil, and is easy to handle so as to overcome the foregoing problems of the prior art.

According to a first aspect of the invention, there is provided a used stencil receptacle comprising: a rectangular base; a pair of long straight sides; and a short straight side. The used stencil receptacle stores used stencils fed from a printing machine in a space defined by the rectangular base, the pair of long straight sides and the short straight side, and the stored used stencils are discharged from the used stencil receptacle via an open end opposite to the short straight side.

In a second aspect of the invention, there is provided a used stencil receptacle in the shape of a box, comprising: a rectangular base; a pair of long straight sides; a short straight side; and a movable short straight side opposite to the short straight side. The used stencil receptacle stores used stencils fed from a printing machine in a space defined by the rectangular base, the pair of long straight sides, the short straight side and the movable short straight side, and the stored used stencils are discarded from the used stencil receptacle via the opened movable short straight side.

In any of the foregoing arrangements, the used stencil receptacle further comprises an L-shaped movable base disposed on the base, and a member for reciprocating the L-shaped movable base along the length of the base from an outside of the used stencil receptacle.

The movable short straight side is pivotally supported at one end thereof to the used stencil receptacle, and is opened and closed by a weight moment thereof when the used stencil receptacle is tilted.

The movable short straight side may be urged to open, and the used stencil receptacle further comprises a stop for keeping the movable short straight side from opening and a stop releasing member for releasing the stop from a function to keep the movable short side closed.

The movable short straight side may be urged to be closed, and the used stencil receptacle further comprises a member for opening the closed movable short straight side.

The used stencil receptacle further comprises a pair of stencil take-up rollers disposed on one of the long straight sides. The used stencil receptacle has either an open or closed top.

The used stencil receptacle further comprises a movable plate standing on the base and a member for reciprocating the movable plate along the length of the base from an outside of the used stencil receptacle.

The used stencil receptacle may be positioned in the printing machine with a longer side thereof facing orthogonally in the direction in which a used stencil is fed, a grip is disposed on the short straight side, and the used stencils are discharged from the used stencil receptacle through a used stencil outlet opposite to the short straight side.

BRIEF DESCRIPTION OF THE DRAWINGS

The present invention will become more fully understood from the detailed description given hereinbelow and the accompanying drawings which are given by way of illustration only, and thus are not limitative of the present invention. In all Figures identical parts have identical reference numbers.

DESCRIPTION OF THE PREFERRED EMBODIMENTS

Figure 1:
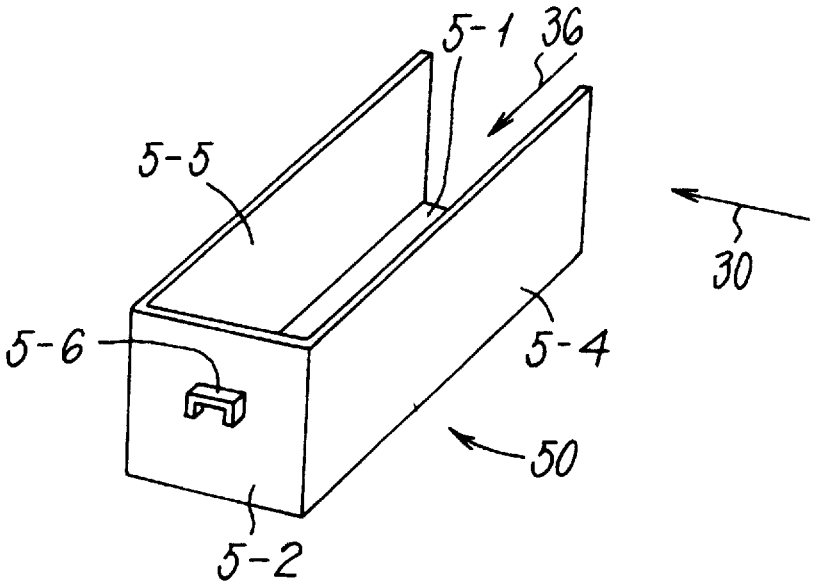
FIG. 1 is a perspective view of a used stencil receptacle according to a first embodiment of the invention.
Figure 2:
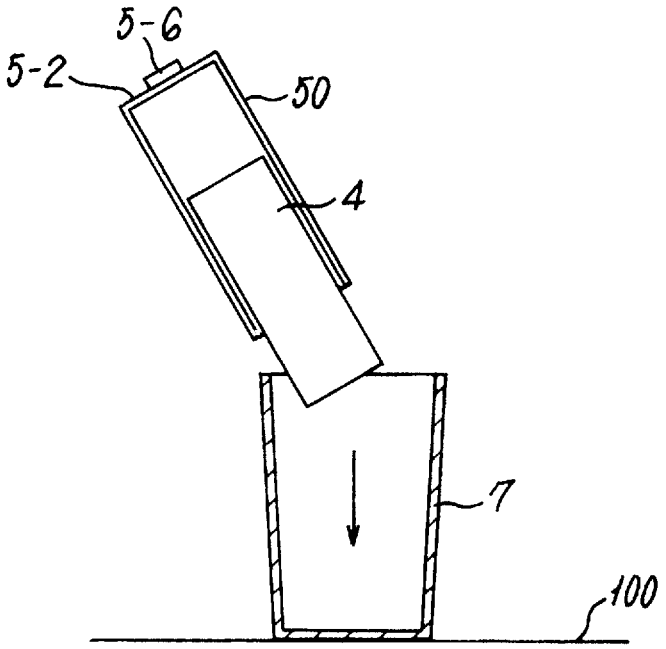
FIG. 2 shows how used stencils are discharged into a trash container.
Figure 17:
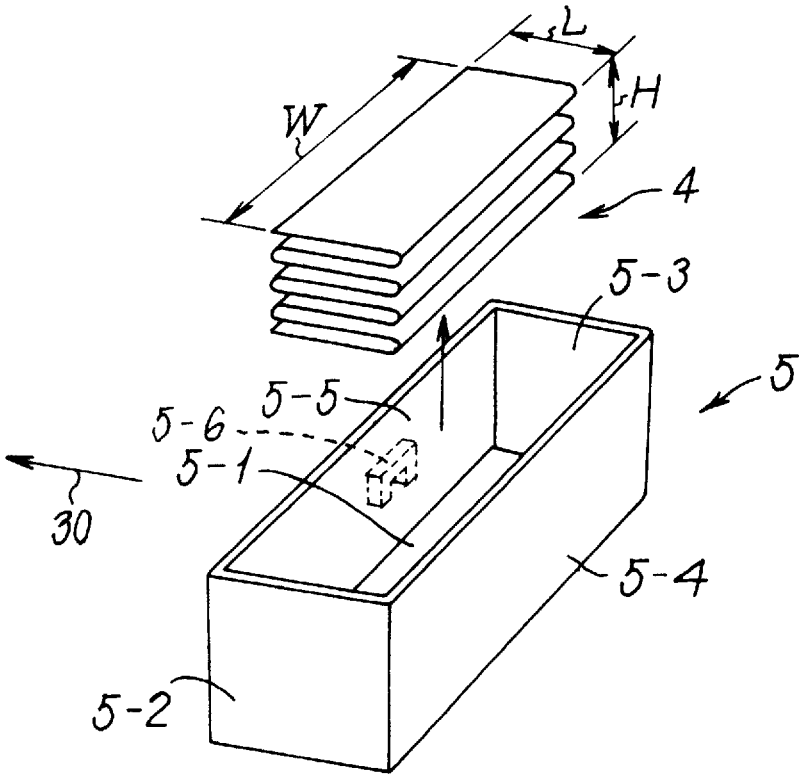
FIG. 17 shows the used stencil receptacle of FIG. 16 and a size of a used stencil.

Embodiment 1:

Referring to FIG. 1, a used stencil receptacle 50 is in the shape of a box comprising a base 5-1, one short straight side 5-2, and a pair of long straight sides 5-4 and 5-5. This used stencil receptacle 50 differs from the used stencil receptacle 5 (shown in FIG. 17) in that it does not have the short straight side 5-3, and that a grip 5-6 is positioned on the short straight side 5-2. Used stencils are discarded through an open side opposite to the short straight side 5-2. The used stencil receptacle 50 is positioned such that its longer side faces the stencil feeding direction 30.

The used stencil receptacle 50 is disposed in the printing machine such that it is movable along the length thereof, using the grip 5-6. An operator in front of the printing machine simply pulls the used stencil receptacle 50 forward, i.e. in a direction shown by the arrow 36 in FIG. 1, thereby removing the receptacle 50 from the printing machine.

Figure 18:
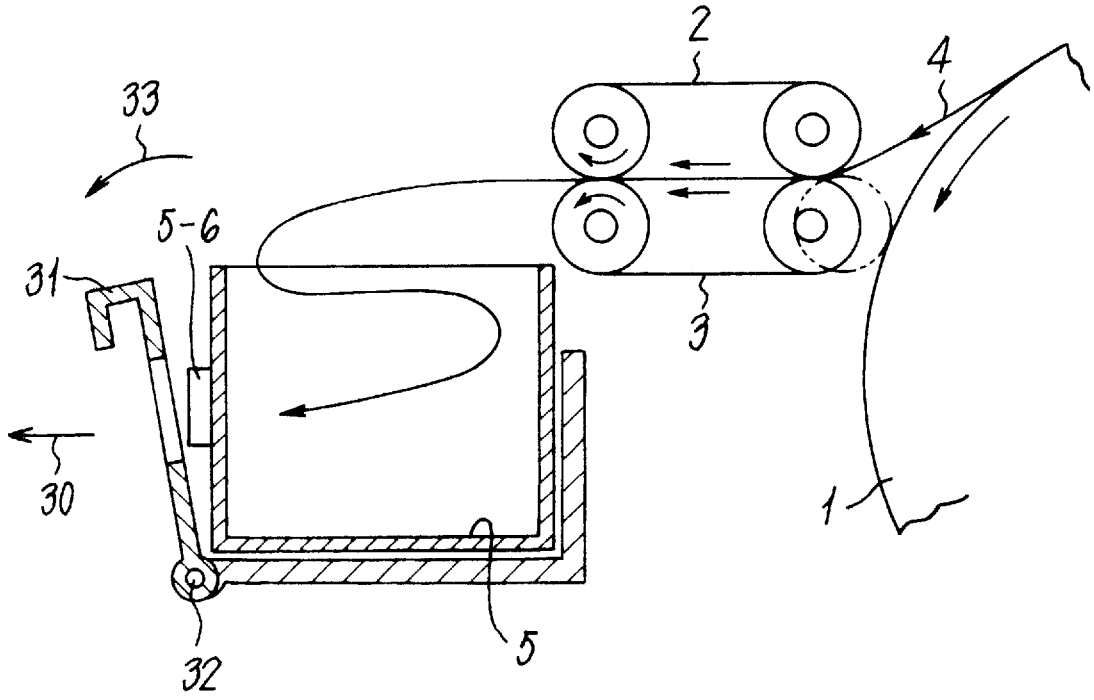
FIG. 18 shows a state in which the used stencil receptacle is being removed.
Figure 19:
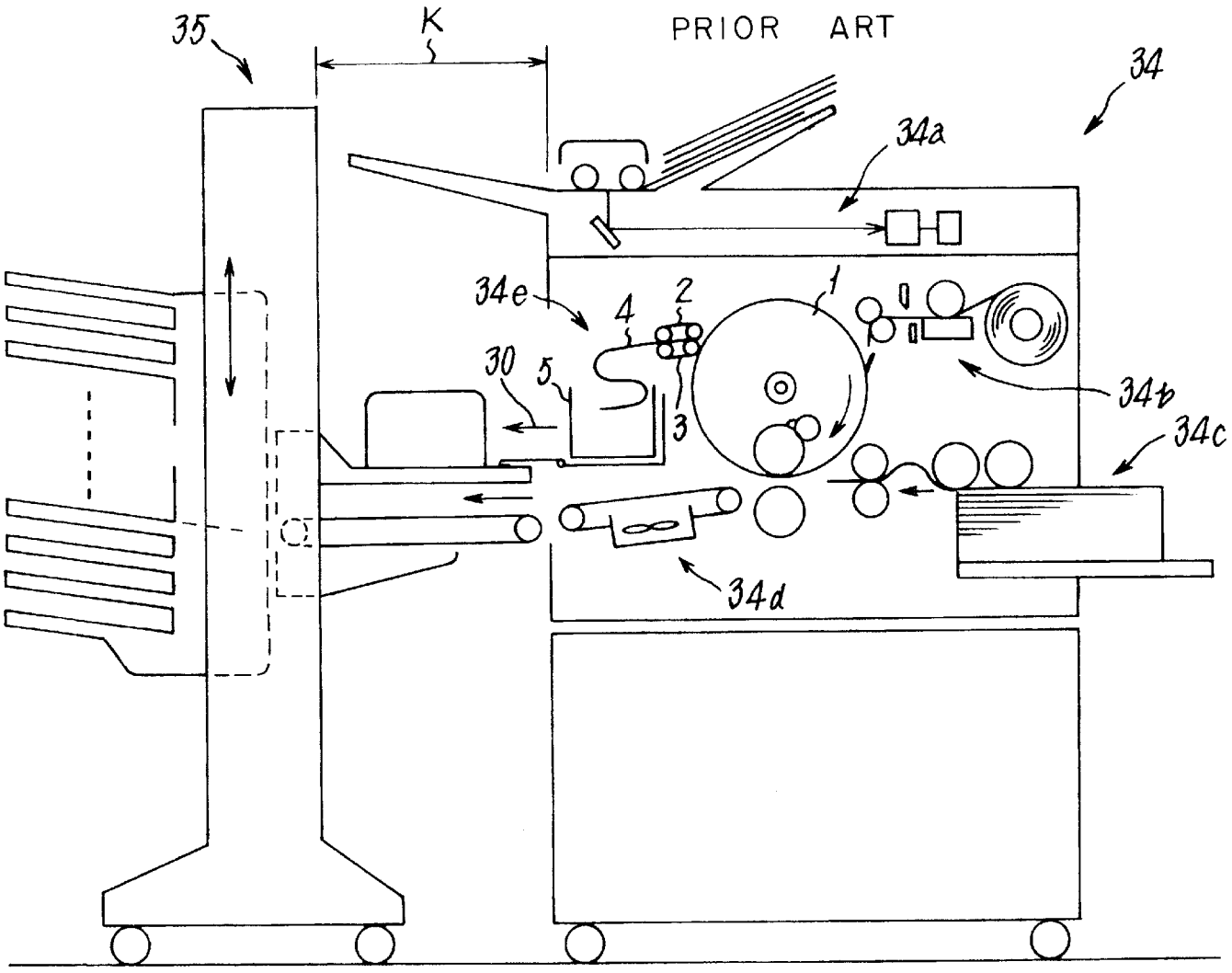
FIG. 19 PRIOR ART
FIG. 19 is a front view of a printing system comprising a printing machine and a sorter in the prior art.
Figure 20:
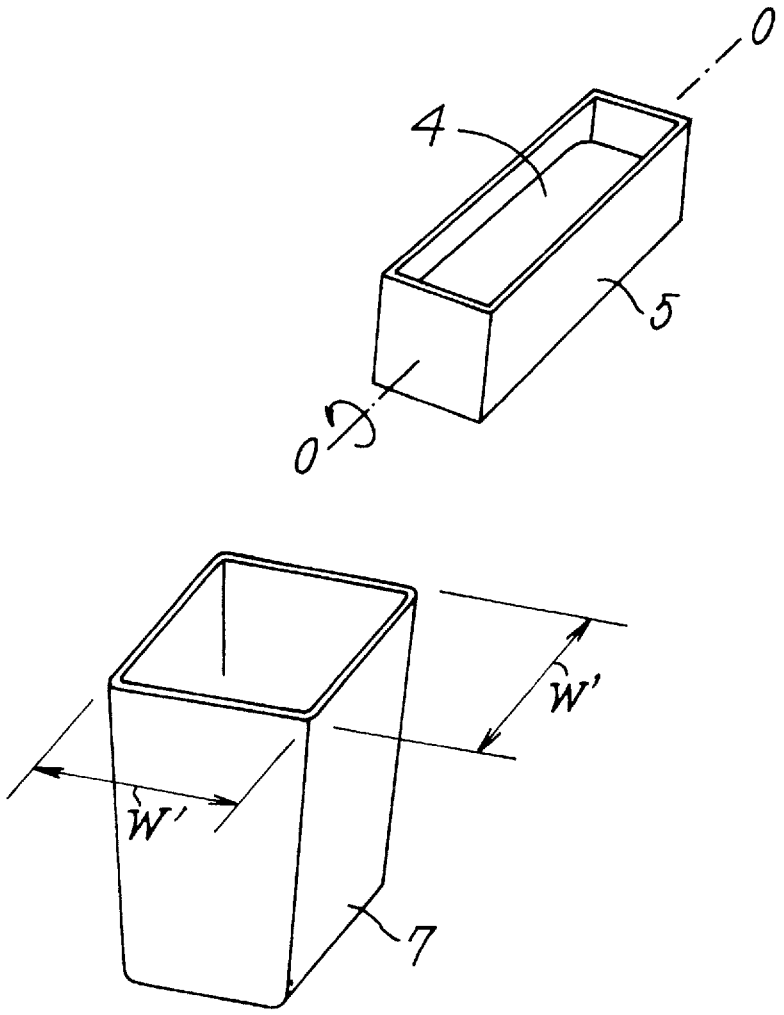
FIG. 20 shows how used stencils are discarded into a trash container from the used stencil receptacle.

In this arrangement, since no holding member 31 (shown in FIG. 18) is provided, it is not necessary to secure space for opening the holding member 31 and space for laterally moving the used stencil receptacle (shown in FIG. 18).

Figure 15:
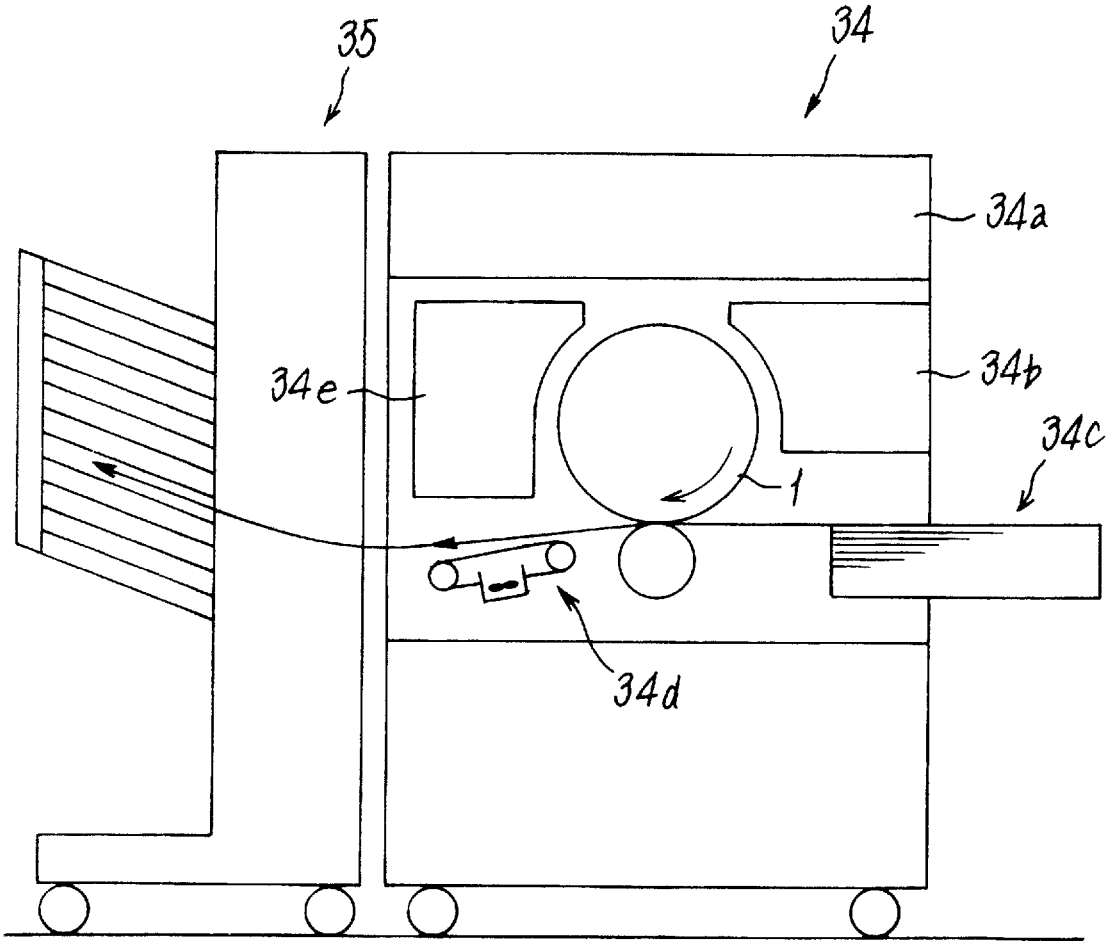
FIG. 15 is a front view of a printing system comprising a printing machine and a sorter.

Therefore, even when the printing machine is located near a wall, the used stencil receptacle 50 can be handled without any problem, which enables the printing machine to be installed at any desired place and the installation space to be utilized efficiently. Further, the printing machine can be placed close to the sorter as shown in FIG. 15. Thus, the overall printing system can reduce its installation space.

When the used stencil receptacle 50 is tilted with its open side coming into contact with a tall trash container 7, the stored used stencils 4 can be easily dumped into the trash container 7 via the open side. In this state, the used stencils 4 fall into the trash container 7 under their own weight.

Embodiment 2:

The used stencils 4 covered with ink on the printing drum are soft, and tend to stick to the base 5-1 of the used stencil receptacle.

In such a case, the used stencils 4 are slow to fall into the trash container 7. Thus, it is necessary to directly push the used stencils 4 forward or pat the used stencil receptacle 50, for example. In a second embodiment, a used stencil receptacle 51 is designed so as to overcome this problem, and enables the used stencils 4 to be smoothly guided into the trash container 7.

Figure 3:
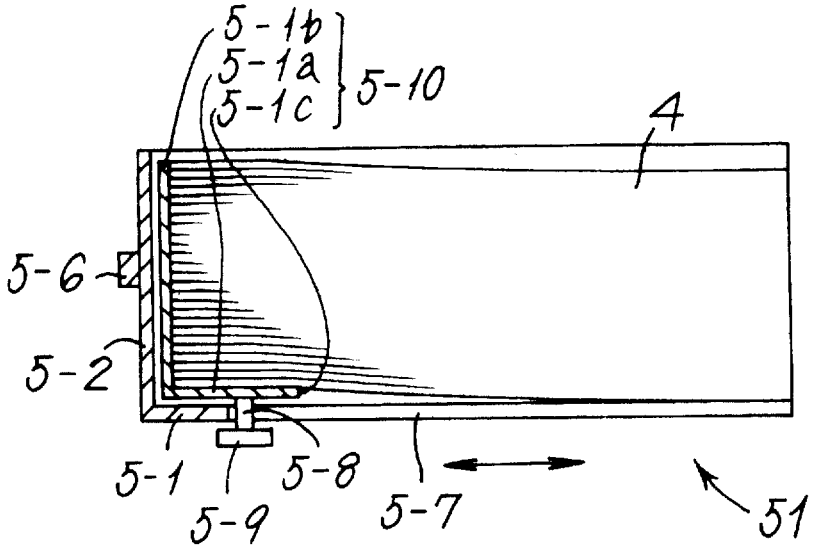
FIG. 3 is a cross section of a used stencil receptacle according to a second embodiment of the invention.

The used stencil receptacle 51 is structured as shown in FIG. 3, and is essentially similar to the used stencil receptacle 50 in the first embodiment. The used stencil receptacle 51 features a base 5-1 that has a longitudinal slit 5-7 in its center, and an L-shaped movable member 5-10 (to be described later).

A shaft 5-8 passes through the longitudinal slit 5-7, and is freely slidable therein. The shaft 5-8 has an integral handle 5-9 on its one end. The shaft 5-8 projects past the base 5-1, and is coupled to the L-shaped movable member 5-10 at the other end thereof.

The L-shaped movable member 5-10 (called "movable member 5-10) includes a base 5-1*a* smaller than the base 5-1 and a short straight side 5-1*b* smaller than the short straight side 5-2. Specifically, the movable member 5-10 is coupled to the shaft 5-8 via its base 5-1*a*.

In this arrangement, the handle 5-9 is moved so as to push the movable member 5-10 along the longitudinal slit 5-7. This enables the used stencils 4 on the base 5-1*a* to be pushed toward the open end. In the used stencil receptacle 51, although the used stencils 4 are partially adhered to the base 5-1*a*, the leading edge 5-1*c* of the base 5-1*a* scrapes the stuck used stencils 4 from the base 5-1 when the movable member 5-10 is moved forward. If the used stencils 4 remain adhered onto the base 5-1, the movable member 5-10 may be moved back and forth several times.

The movable member 5-10 is designed so as to be fitted in a space defined by the two long straight sides 5-4 and 5-5, the short straight side 5-2, and the base 5-1, and functions to guide the used stencils 4 by the base 5-1*a* and the short straight side 5-1*b*.

The shaft 5-8 may be of any shape. If it has two sides which are in conformity with the shape of the slit 5-7, the shaft 5-8 can more reliably guide the movable member 5-10.

During its movement, the movable member 5-10 frees the used stencils 4 from the long straight sides 5-4 and 5-5, so that the used stencils 4 fall into the trash container under their own weight.

The slit 5-7, shaft 5-8 and handle 5-9 constitute a member for reciprocating the movable member 5-10 in the longitudinal direction. This member is disposed on the outer surface of the base 5-1, and is operated from the exterior of the used stencil receptacle 51.

Embodiment 3:

In a third embodiment shown in FIG. 4, a used stencil receptacle 52 is substantially identical to the used stencil receptacle 51 in the second embodiment, but differs from the latter in the following respect. In this embodiment, the L-shaped movable base 5-10 is reciprocated by a pair of handles 5-9' and 5-9" which are movable in the slits 5-7' and 5-7" on the long straight sides 5-4 and 5-5. Specifically, the handles 5-9' and 5-9" outwardly extend through the slits 5-7' and 5-7" and are movable therein. The base 5-1*a* (in FIG. 4) of the movable base 5-10 is slightly longer than the base 5-1*a* in the second embodiment (in FIG. 3), and functions as a spatula for scraping the used stencils 4 off the base 5-1*a*.

In this embodiment, the movable base 5-10 is reciprocated via the handles 5-9' and 5-9" in the slits 5-7' and 5-7" so as to promote discharging of the used stencils 4. The position of the members for moving the movable base 5-10 depends upon the layout of the printing system, and operability of the used stencil receptacle, and so on.

Figure 5:
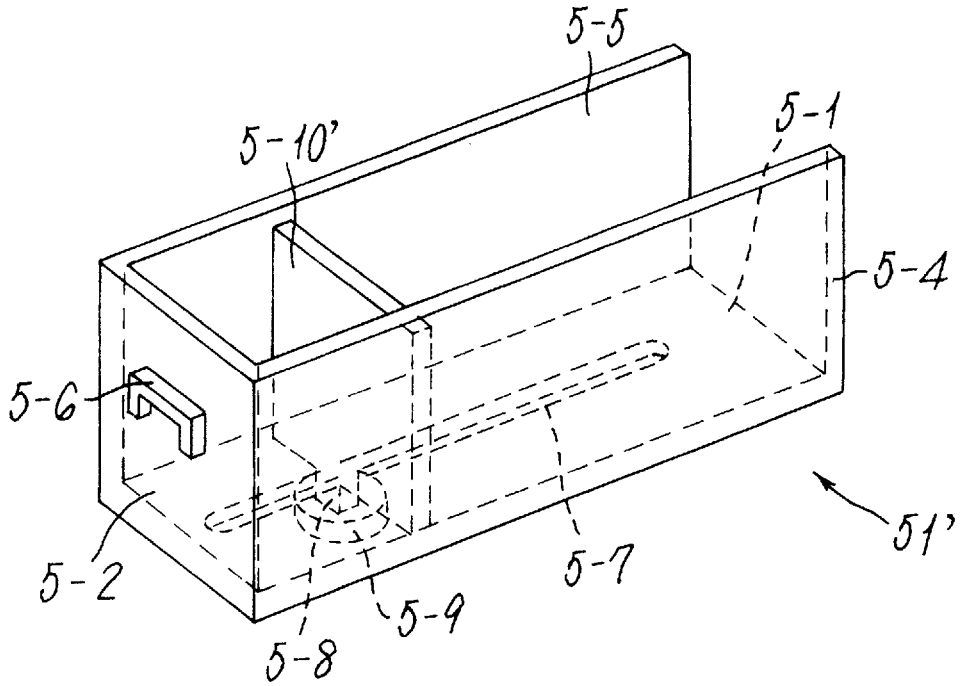
FIG. 5 is a perspective view of a used stencil receptacle according to a fourth embodiment.

Embodiment 4:

Referring to FIG. 5 a fourth embodiment is a modification of the third embodiment. A used stencil receptacle 51' features a movable base 5-10' that is a plate standing on the base 5-1. The movable base 5-10' is moved on the base 5-1 by pushing a handle 5-8 which is integral with the movable base 5-10' and extends outward through the base 5-1. The operation of the movable base 5-10' is the same as that of the movable base 5-10 in the third embodiment, and will not be described here.

Figure 6:
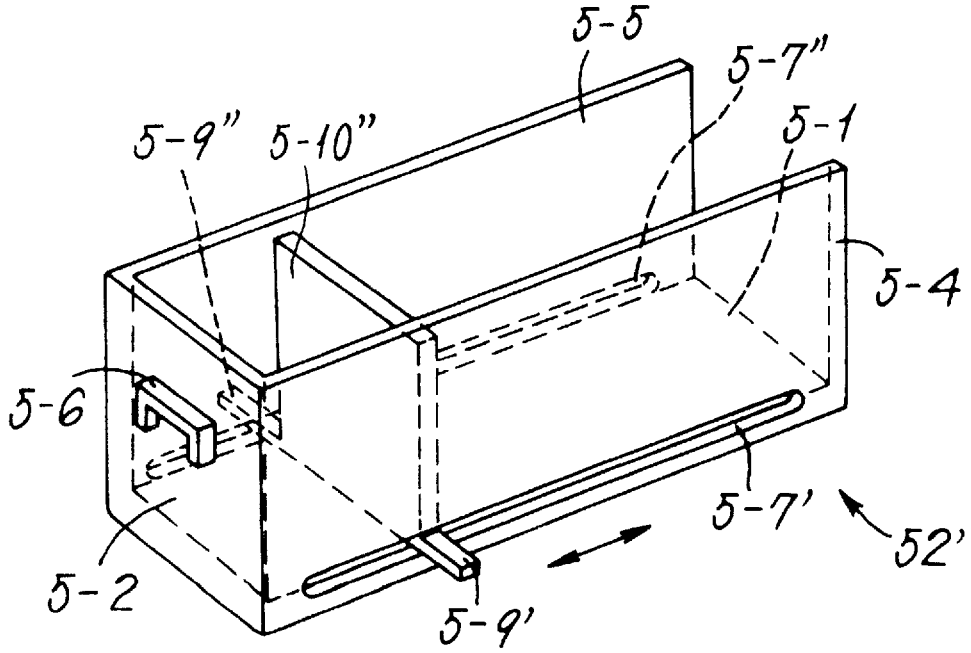
FIG. 6 is a perspective view of a used stencil receptacle according to a fifth embodiment.

Embodiment 5:

This embodiment is a modification of the fourth embodiment, and features a pair of handles 5-9' and 5-9" which are located at the opposite side edges of a movable base 5-10" as shown in FIG. 6. The movable base 5-10" is a straight plate in place of the L-shaped movable base 5-10 (in FIG. 4), and is reciprocated in a used stencil receptacle 52' using the foregoing handles 5-9' and 5-9" which are longitudinally slidable in slits 5-7' and 5-7" on the long straight sides 5-4 and 5-5.

Figure 7:
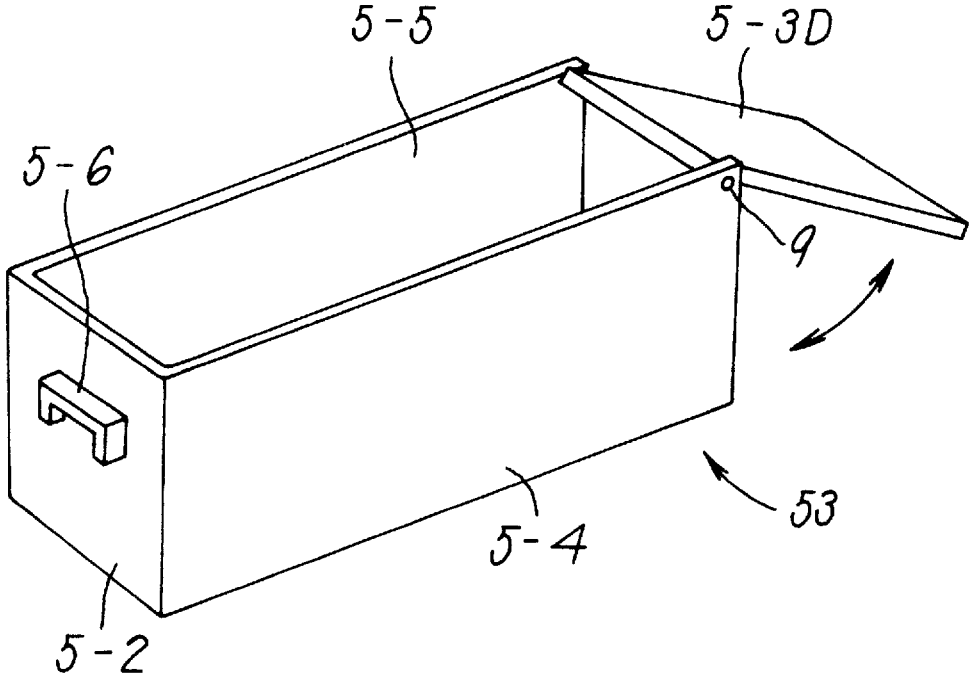
FIG. 7 is a perspective view of a used stencil receptacle according to a sixth embodiment.

Embodiment 6:

A used stencil receptacle 53 in this embodiment comprises the components same as those in the foregoing embodiments, but further comprises a movable side 5-3D which is at the open side opposite to the short straight side 5-2, as shown in FIG. 7.

The movable side 5-3D is joined to the long straight sides 5-4 and 5-5 via a pair of pivots 9 which are at the top corners of the long straight sides 5-4 and 5-5 adjacent to the open end opposite to the short straight side 5-2 having the grip 5-6 thereon. Alternatively, the pivots 9 may be disposed at any positions on the top and bottom edges of the long straight sides 5-4 and 5-5, adjacent to the open end.

The movable side 5-3D remains upright by its own weight moment while the used stencil receptacle 53 is placed in the printing machine, thereby closing the used stencil receptacle 53. When the used stencil receptacle 53 is tilted with the movable side 5-3D kept low, the movable side 5-3D is opened by its own weight moment, so that the used stencils 4 will be dumped into the trash container 7. Alternatively, the movable side 5-3D may be of a double encasement type in place of the single encasement type of this embodiment.

The movable side 5-3D usually remains closed except for when the used stencils 4 are dumped into the trash container. Thus, the arrangement is effective in preventing the operator from touching the used stencils 4 and being stained by the used stencils 4.

Figure 8:
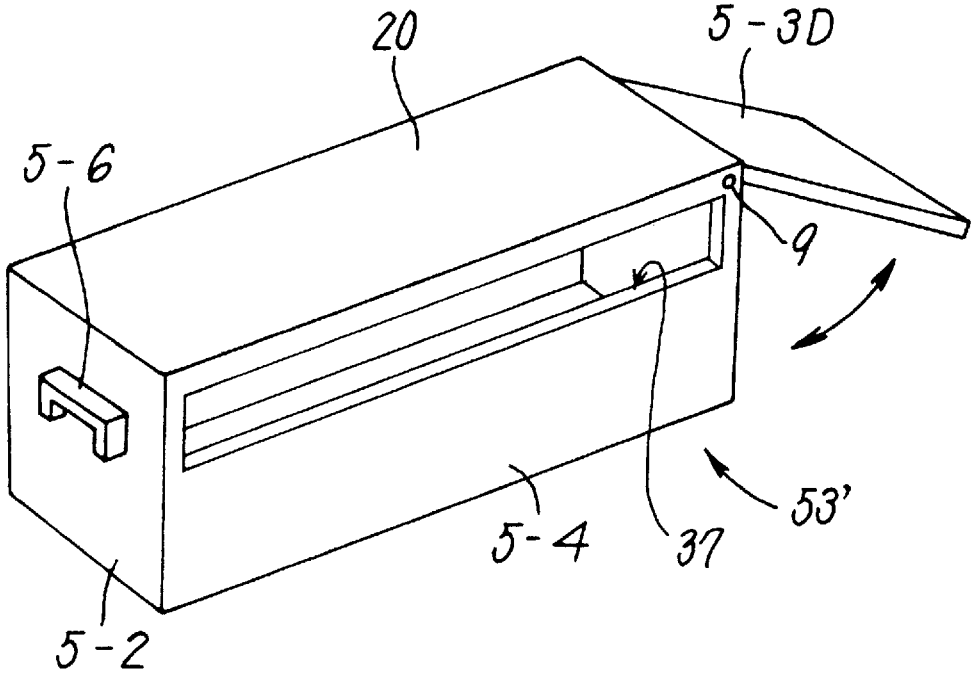
FIG. 8 is a perspective view of a used stencil receptacle according to a seventh embodiment.

Embodiment 7:

FIG. 8 is a perspective view of a used stencil receptacle 53' according to a seventh embodiment of the invention. The used stencil receptacle 53' is a modification of the used stencil receptacle 53 of the sixth embodiment, and differs from it in the following respects. The used stencil receptacle 53' also includes a top cover 20, and a window 37 formed on the long straight side 5-4. Each used stencil 4 is discharged into the used stencil receptacle 53' via the window 37. Thus, the used stencil receptacle may have either an open or closed top depending upon how the used stencils are guided thereinto.

When the used stencil receptacle has a closed top as in this embodiment, a member such as the pushing member 6 (in FIG. 16) is attached on the inner surface of the top cover 20, and is simply required to compress the stacked used stencils in a compact manner. This is not directly related to the present invention, and will not be described here.

Figure 9:
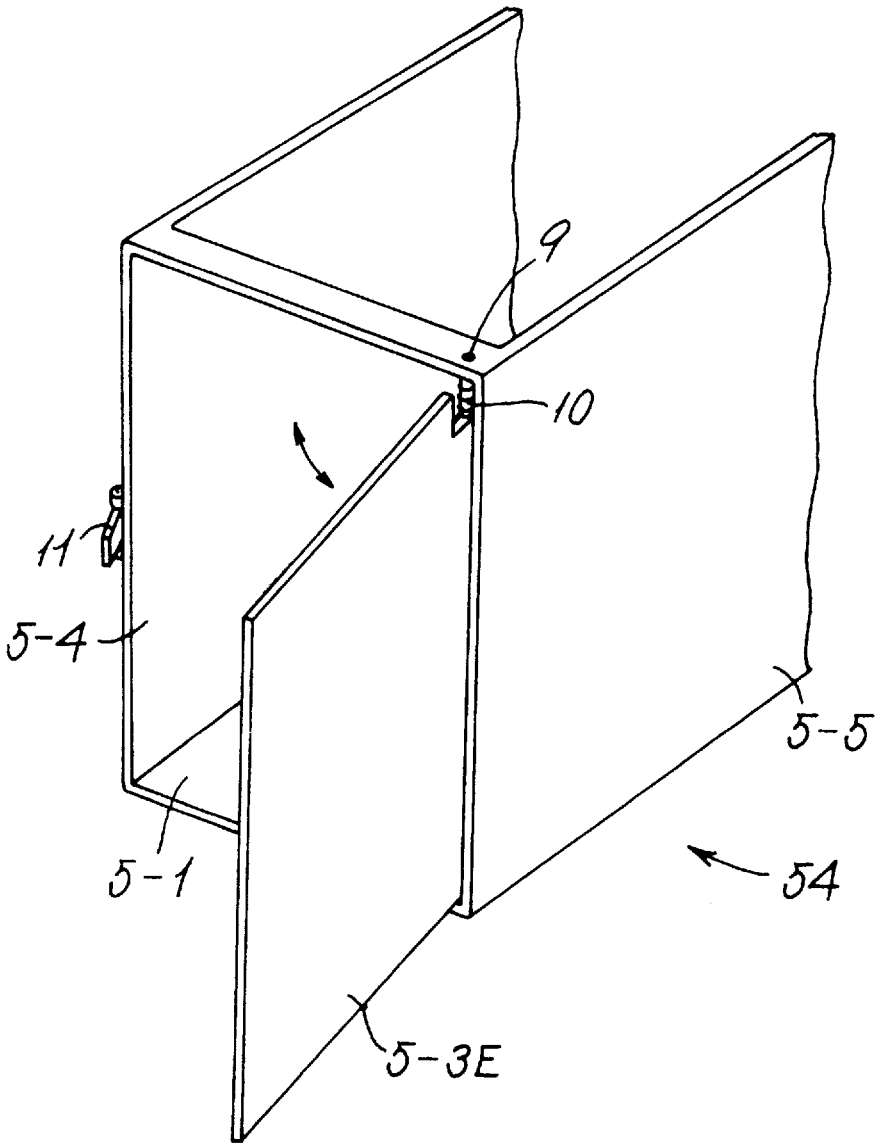
FIG. 9 is a partial perspective view of a used stencil receptacle according to an eight embodiment, particularly showing a movable side.
Figure 10:
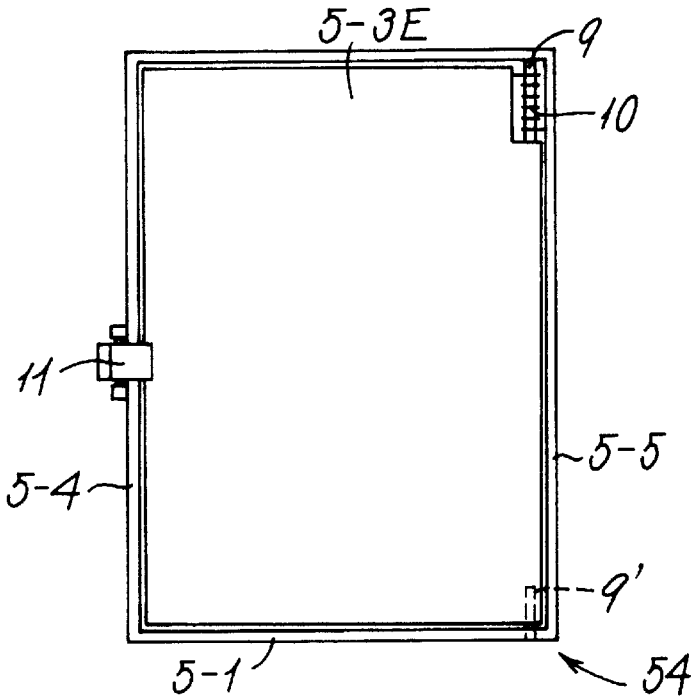
FIG. 10 is a side cross section, viewed from the movable side, of the used stencil receptacle shown in FIG. 9.
Figure 11:
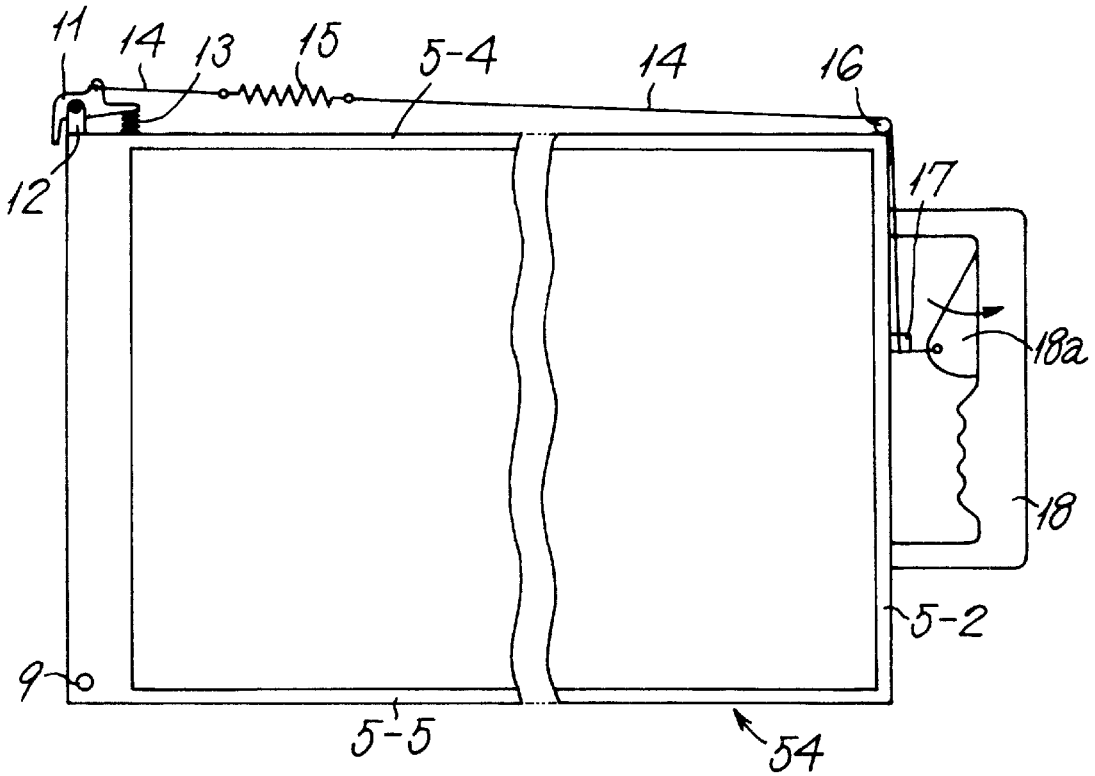
FIG. 11 is a plan view of the used stencil receptacle of FIG. 9.

Embodiment 8:

In an eighth embodiment, the movable side 5-3D of FIG. 7 is modified as shown in FIGS. 9 to 11. The foregoing movable side 5-3D is opened and closed by its own weight moment. On the contrary, a movable side 5-3E is urged to open, and is usually kept closed by a stop 11. In order to discharge the used stencils 4, the stop 11 is released so as to open the movable side 5-3E. The movable side 5-3E is manually closed.

The movable side 5-3E is supported by pivots 9 and 9' embedded in a used stencil receptacle 54. The pivot 9 has a torsion coil spring 10 wound thereon as shown in FIGS. 9 and 10. The torsion coil spring 10 is connected to the movable side 5-3E at one end, and to the pivot 9 at the other end. The movable side 5-3E is urged to open by the torsion coil spring 10.

As clearly shown in FIG. 11, the stop 11 is in the shape of a claw which is pivotally joined by a support on the long straight side 5-4, and can freely rock. The stop 11 maintains the movable side 5-3E closed. The other end of the stop 11 is fixed to the long straight side 5-4 via a stretchable spring 13. In other words, the stop 11 is urged to hold the free end of the movable member 5-3E.

The stop 11 has a projection on the side opposite to the support 12. A wire 14 extends between the projection of the stop 11 and a trigger 18*a* of a grip 18 positioned on the short straight side 5-2, via members 16 and 17. The wire 14 has a resilient spring 15 as shown in FIG. 11. The stretchable spring 13 is designed to have a spring constant such that it is flexed when the resilient spring 15 is pulled. In other words, the resilient spring 15 functions to absorb slackness of the stretchable spring 13.

When the trigger 18*a* holding the movable side 5-3E is pulled, the stop 11 is rocked in a direction for freeing the movable side 5-3E, so that the movable side 5-3E will open. Thus, the used stencils 4 will be discharged into the trash container via the open side of the used stencil receptacle 54.

Thereafter, the movable side 5-3E will be returned to a closed state by pulling the trigger 18*a*. When the trigger 18*a* is released, the stop 11 will resume its function, i.e. keep the movable side 5-3E closed.

The wire 14, spring 15, trigger 18*a* and so on constitute the main parts of a stop releasing member for releasing the stop 11 from its function to keep the movable side 5-3E closed. This arrangement is effective in reliably keeping the movable side 5-3E closed or opened.

Embodiment 9:

In a ninth embodiment, a used stencil receptacle 55 features that a movable side is urged to close and a member for opening such a movable member, contrary to the movable side shown in FIGS. 9 to 11.

Figure 12:
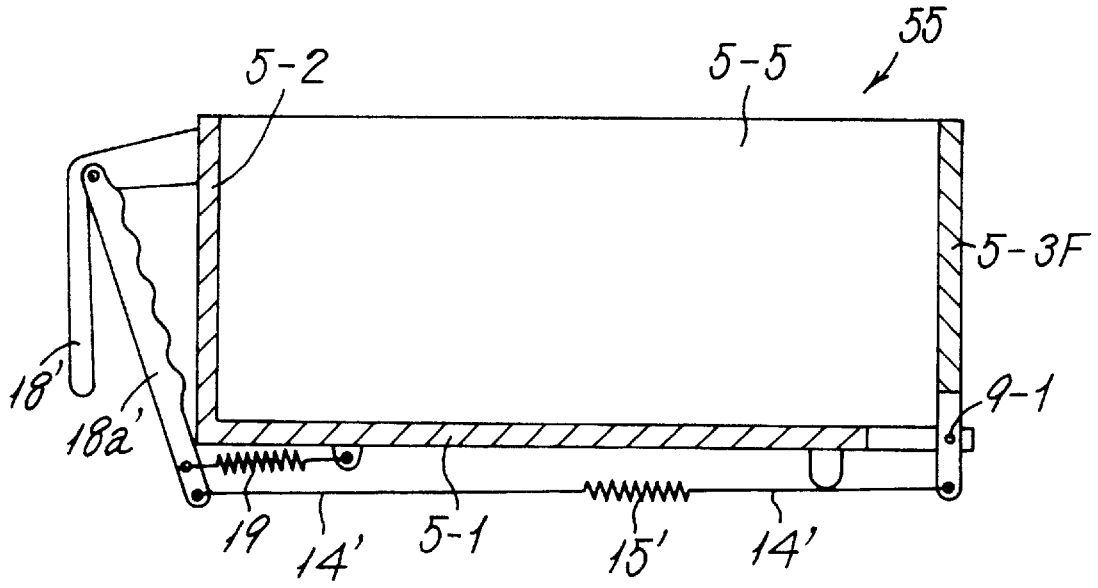
FIG. 12 is a cross section of a used stencil receptacle according to a ninth embodiment.

Referring to FIG. 12, the movable side 5-3F is supported at one end of the base 5-1 via a pair of pivots 9-1, and is urged to close by a torsion coil spring which is similar to that shown in FIG. 10.

A handle 18', which corresponds to any of the grips in the foregoing embodiments, is attached to the short straight side 5-2, and includes a trigger 18*a'* attached near a center thereof. A wire 14' having a resilient spring 15' extends between a free end of the trigger 18*a'* and one of the pivots 9-1. The trigger 18*a'* is urged to be in contact with the end of the base 5-1 (near the short straight side 5-2) by a resilient spring 19 so as to keep its steady state. Usually, when it is closed, the movable side 5-3F is in contact with edges of the long straight sides 5-4 and 5-5.

The movable side 5-3F remains closed while no external force is applied to the trigger 18*a'*. However, when the trigger 18*a'* is pulled, the movable side 5-3F is opened by the wire 14'. In this embodiment, the wire 14', trigger 18*a'* and so on mainly constitute a member for opening the movable side 5-3F, and for reliably keeping the open or closed state of the movable side 5-3F.

Embodiment 10

Figure 4:
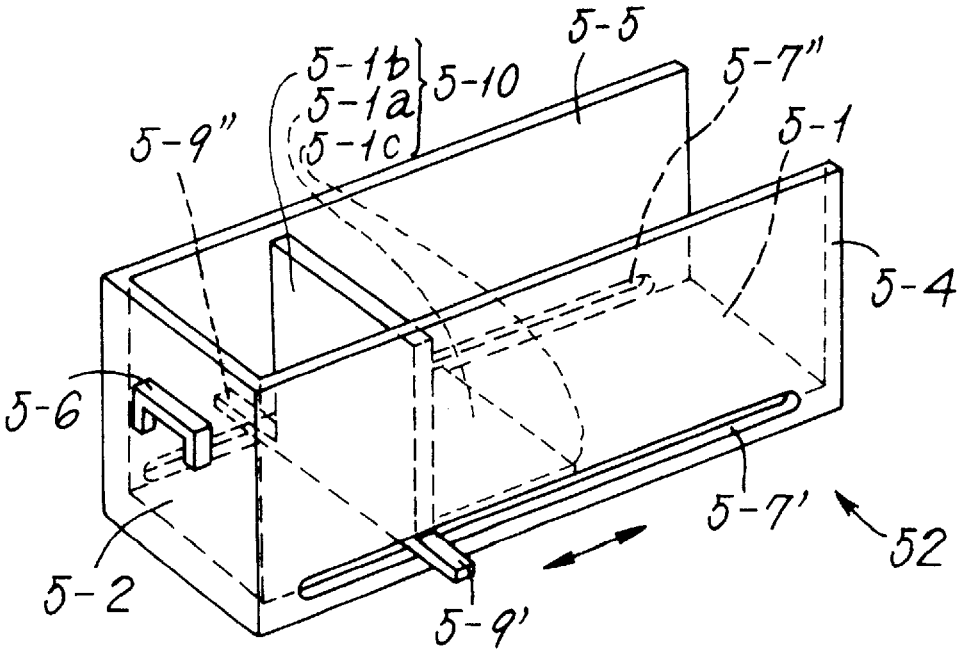
FIG. 4 is a perspective view of a used stencil receptacle according to a third embodiment of the invention.
Figure 13:
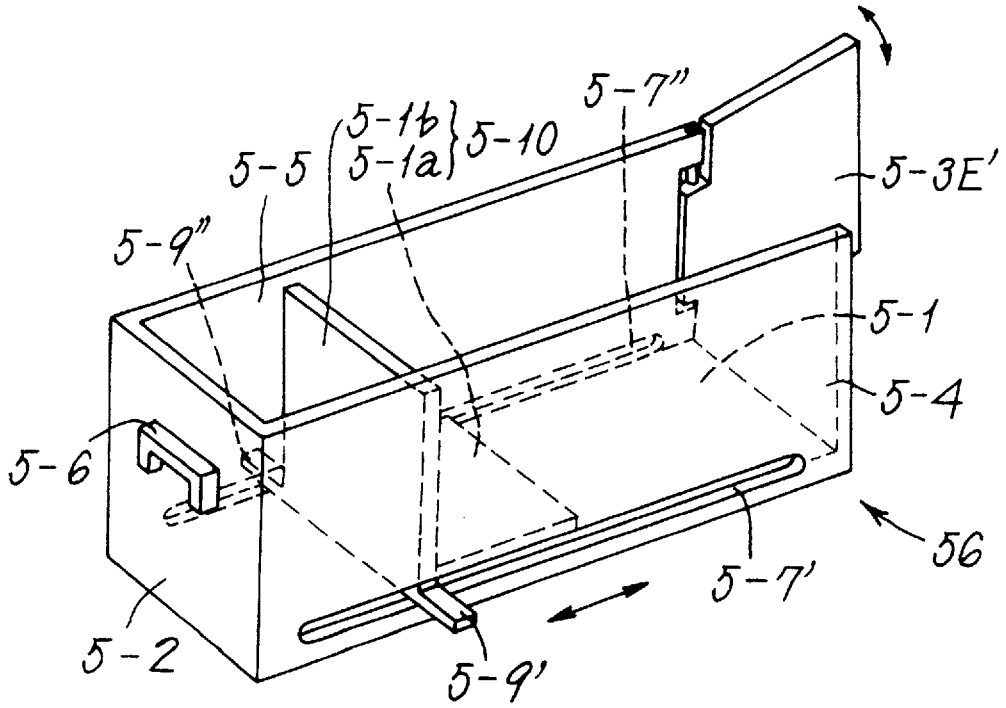
FIG. 13 is a perspective view of a used stencil receptacle according to a tenth embodiment.

In a tenth embodiment shown in FIG. 13, a used stencil receptacle 56 is a combination of the structure shown in FIG. 4 and the structure shown in FIG. 7, FIGS. 9 to 11, or FIG. 12. The movable base 5-10 is identical to that shown in FIG. 4, and will not be described here in detail.

A movable side 5-3E' is substantially identical to the movable side 5-3E shown in FIG. 9. The movable side 5-3E' is opened and closed by its own weight. Alternatively, the movable side 5-3E' is urged to close by the torsion coil spring, and is opened by the opening member, shown in FIG. 12.

According to this embodiment, when loaded in the printing machine, the used stencil receptacle 56 can keep the used stencils 4 from coming into contact with other objects. When it is removed from the printing machine and is tilted, the used stencil receptacle 56 enables the used stencils to fall down. Further, the movable base 5-10 enhances the fall of the used stencils.

Figure 16:
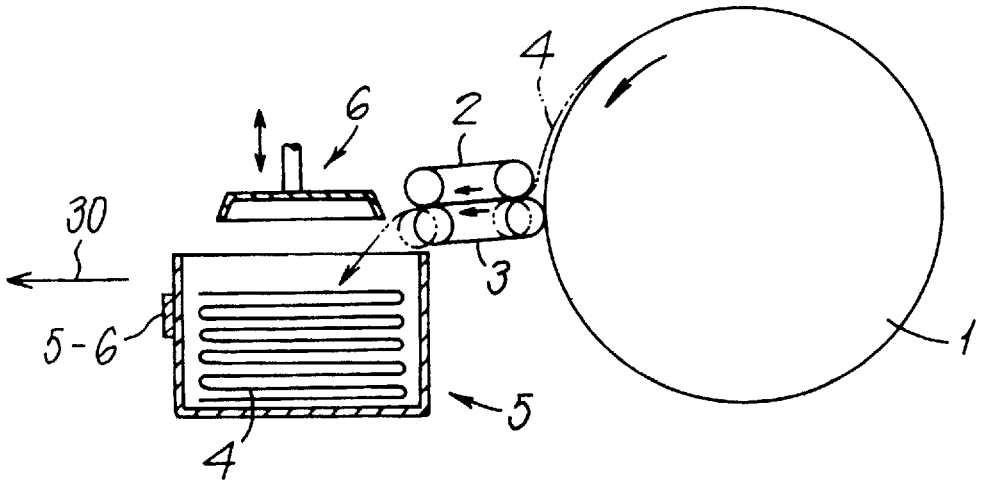
FIG. 16 PRIOR ART
FIG. 16 is a schematic view showing the arrangement of a used stencil receptacle and a printing drum in a printing machine of the prior art.

Embodiment 11:

The used stencil receptacles of the first to tenth embodiments are used to store the used stencils carried via stencil take-up belts, such as the stencil take-up belts 2 and 3 which are disposed downstream of the printing drum 1, as shown in FIG. 16.

In the prior art shown in FIG. 16, each used stencil is stripped off from the printing drum, is carried by the stencil take-up belts to the used stencil receptacle, and stored therein. The foregoing carrying step is not an essential part of the printing operation. Further, the maximum amount of the used stencils stored in the receptacle 5 is regulated to a level of the upper surface of the stencil take-up belt 3.

In an eleventh embodiment, a used stencil receptacle 57 is designed so as to overcome the foregoing problems, and includes a pair of stencil take-up rollers 100 as its integral parts which are disposed near the printing drum. Since the used stencils are directly put into the used stencil receptacle via the stencil take-up rollers 100, the used stencil receptacle is not always required to have an open top. The used stencil receptacle may be sealed, for example.

Figure 14:
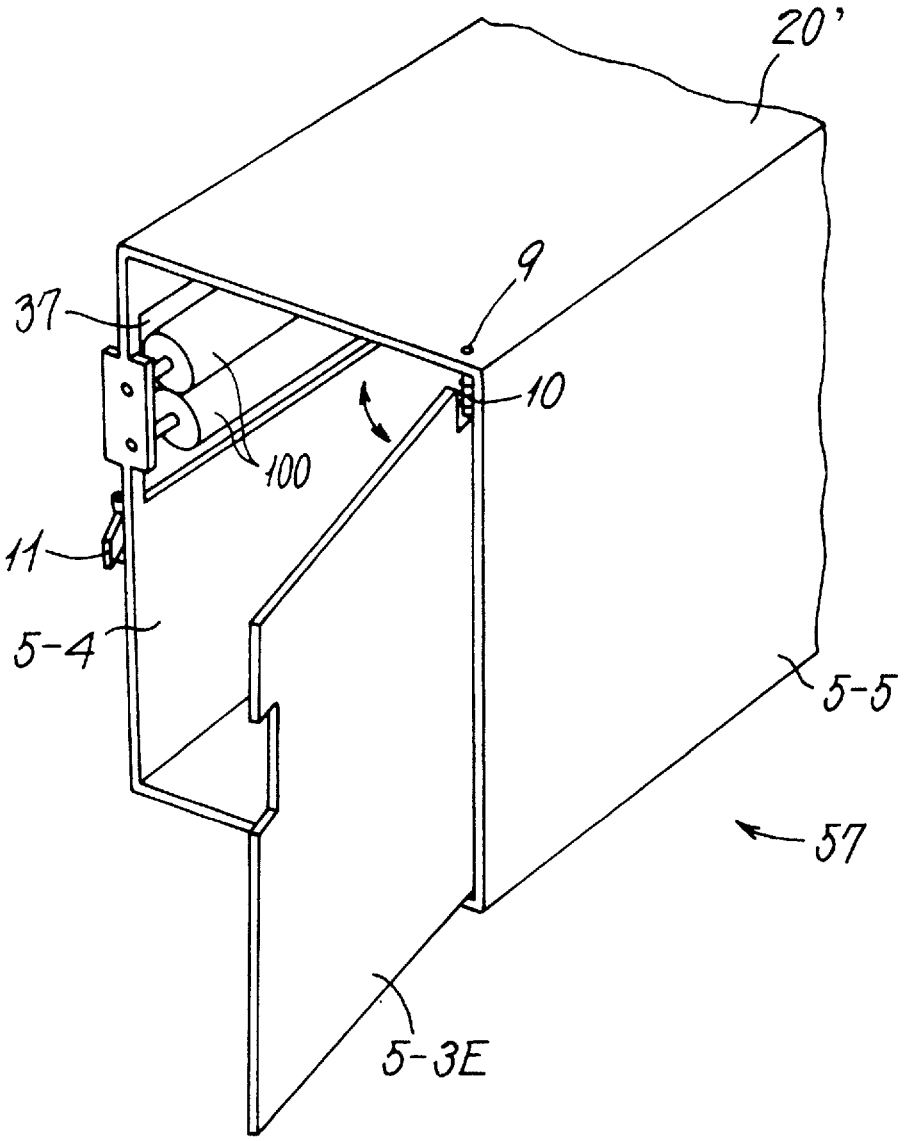
FIG. 14 is a perspective view of a part of a used stencil receptacle according to an eleventh embodiment.

Except for the stencil take-up rollers 100, the used stencil receptacle 57 of this embodiment can use the structure referred to in any of the first to tenth embodiments, as shown in FIG. 14. Specifically, the used stencil receptacle 57 is a combination of the structure shown in FIG. 8 and the structure shown in FIGS. 9 to 11. Specifically, the used stencil receptacle 57 is substantially identical to the used stencil receptacle 54 except for a window 37 where the stencil take-up rollers 100 are disposed, and a top plate 20'.

According to the invention, the used stencil receptacle can discharge the used stencils into a trash container having a small opening, and can be easily returned into the printing machine.

What is claimed is:

1. A used stencil receptacle detachably mounted in combination with a printing machine and in the shape of a box, comprising:

(a) a rectangular base;

(b) a pair of long straight sides;

(c) a short straight side;

(d) an open end, the open end located opposite to the short straight side; and (e) an open top, the open top located opposite the rectangular base, wherein the used stencil receptacle receives used stencils fed from the printing machine through said open top and stores said used stencils for subsequent disposal from the used stencil receptacle via the open end opposite to the short straight side.

2. The used stencil receptacle according to claim 1, further comprising an L-shaped movable base disposed on the base, and a member for reciprocating the L-shaped movable base along the length of the base from an outside of the used stencil receptacle.

3. The used stencil receptacle according to claim 1, further comprising a pair of stencil take-up rollers disposed on one of long straight sides.

4. The used stencil receptacle according to claim 1, further comprising a movable plate standing on the base and a member for reciprocating the movable plate along the length of the base from an outside of the used stencil receptacle.

5. The used stencil receptacle according to claim 1, used stencil receptacle is positioned in the printing machine with a longer side thereof facing further comprising a grip disposed on the short straight side, and the used stencils are discarded from the used stencil receptacle through a used stencil outlet opposite to the short straight side, wherein the used stencil receptacle is positioned in the printing machine with a longer side thereof facing orthogonally to the direction in which a used stencil is fed.

6. A used stencil receptacle according to claim 1, further comprising a movable short straight side opposite to the short straight side, the movable short straight side located at the open end when the movable short straight side is closed, wherein the used stencils are discarded from the used stencil receptacle via the open movable short straight side.

7. The used stencil receptacle according to claim 6, wherein the short movable straight side is pivotally supported at one end thereof to the used stencil receptacle, and is opened and closed by a weight moment thereof when the used stencil receptacle is tilted.

8. The used stencil receptacle according to claim 6, wherein the short movable straight side is urged to open, and the used stencil receptacle further comprises a stop for keeping the short movable straight side from opening and a stop releasing member for releasing the stop from functioning to keep the short movable side closed.

9. The used stencil receptacle according to claim 6, wherein the movable short straight side is urged to be closed, and the used stencil receptacle further comprises a member for opening the closed movable short straight side.

10. The used stencil receptacle according to claim 6, further comprising a grip disposed on the short straight side, and the used stencils are discarded from the used stencil receptacle through a used stencil outlet opposite to the short straight side, wherein the used stencil receptacle is positioned in the printing machine with a longer side thereof facing orthogonally to the direction in which a used stencil is fed.

11. The used stencil receptacle according to claim 6, further comprising an L-shaped movable base disposed on the base, and a member for reciprocating the L-shaped movable base along the length of the base from an outside of the used stencil receptacle.

12. The used stencil receptacle according to claim 6, further comprising a pair of stencil take-up rollers disposed on one of long straight sides.

13. The used stencil receptacle according to claim 6, further comprising a movable plate standing on the base and a member for reciprocating the movable plate along the length of the base from an outside of the used stencil receptacle.

* * * * *

UNITED STATES PATENT AND TRADEMARK OFFICE

CERTIFICATE OF CORRECTION

PATENT NO. : 5,862,752

DATED : JANUARY 26, 1999

INVENTOR(S): Takayuki TAKAHASHI, et al.

It is certified that an error appears in the above-identified patent and that said Letters Patent is hereby corrected as shown below:

In Column 9, lines 34 through 36 delete "used stencil receptacle is positioned in the printing machine with a longer side thereof facing"

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*